United States Patent [19]

Campbell

[11] Patent Number: 4,946,079

[45] Date of Patent: Aug. 7, 1990

[54] VENTED AND VALVED POURING SPOUT

[76] Inventor: John T. Campbell, P.O. Box 126, Midwest, Wyo. 82643

[21] Appl. No.: 222,898

[22] Filed: Jul. 21, 1988

[51] Int. Cl.[5] ..... B67D 3/00

[52] U.S. Cl. ..... 222/484; 222/548; 222/568

[58] Field of Search ..... 222/482, 484, 460, 568, 222/501, 547, 556, 564, 548; 141/181, 301, 306; 285/175, 460, 556

[56] References Cited

U.S. PATENT DOCUMENTS

| | | | |
|---|---|---|---|
| 196,084 | 10/1877 | Guyer | 285/175 |
| 2,113,046 | 5/1938 | Freeman | 222/484 |
| 2,790,583 | 5/1957 | Kolehda | 222/556 |
| 2,841,313 | 7/1958 | Beall, Jr. | 222/484 |
| 3,467,287 | 9/1969 | Marchant et al. | 222/548 |
| 3,847,523 | 11/1974 | Parrish et al. | 222/568 |

*Primary Examiner*—Kevin P. Shaver
*Assistant Examiner*—W. Todd Waffner
*Attorney, Agent, or Firm*—Edwin L. Spangler, Jr.; Richard W. Hanes

[57] ABSTRACT

A pouring spout for attachment to liquid containers having superimposed passages therein, one for air to enter the container and the other for fluid to exit therefrom. a thumb-actuated ball valve seated in fluid-tight relation within a spherically-shaped pocket intermediate the ends of the spout becomes operative to either open or close both passages simultaneously upon rotation of the valve a quarter of a turn through the use of the thumb of the hand holding the container. The intake end of the spout is formed to provide it with a flared skirt cooperating with it to define a funnel effective to direct fluid into the latter when used separate from a container.

1 Claim, 3 Drawing Sheets

10
12
14
16
18
20
22
24
28
30
36
52
58
70
74
2

10
12
14
14A
14B
16
16A
16B
18
20
22
24
28
30
36
38
42
44
46
48
50
52
54
58
60
62
64
66
70
74
76
78
82
84
86
88
90
92L
92U
100
3
4

12
14B
16B
18
36
38
40
42
44
46
48
50
52
54
58
64
66

10
14
16

VENTED AND VALVED POURING SPOUT

BACKGROUND OF THE INVENTION

The cylindrical metal or cardboard containers in which engine oil has been, and sometimes still is, packaged are being replaced by molded plastic bottles. Pouring from the cans was facilitated to a degree by pouring spouts that punctured the lid of the container and hopefully sealed around the opening thus produced so that the oil would not leak at the interface. Unfortunately, this seal was seldom effective and a certain amount of oil leaked out onto the engine. Even more of a problem was, however, the lack of any valve that permitted the user to turn the container upside down without spilling its contents. The solution, therefore, was to hold the spout close to the oil intake opening and quickly turn the can upside down hoping that you hit the hole with the contents. As often as not, a good deal of it spilled onto the engine and dripped from there down onto the garage floor or driveway. These prior art can-puncturing spouts, however, had the advantage of admitting a certain amount of air to the can such that at least the contents poured out in a smooth stream.

The plastic bottle, while doing away with the necessity of puncturing the lid to get at the contents, nevertheless, has its own problems. To begin with it is every bit as difficult, if not more so, to pour from and hit the oil intake opening unless one uses a funnel. Moreover, since the pour opening is small, no air can enter the container and the contents come out "gurgling" and in surges which means that a good deal of it either overshoots or undershoots the opening thus resulting in more of a spill than one experienced with the prior art puncture type pouring spouts for use with metal-lidded cans and cardboard containers.

1. Field of the Invention

The present invention relates, therefore, to an improved pouring spout for liquid containers, particularly those in which engine oil is packaged, that is characterized by both a thumb-actuated ball valve mechanism conveniently located in the spout that permits the user to turn the container upside down with the spout in the oil intake opening in the valve cover before releasing the contents and, in addition, an air intake tube reaching into the bottom of the container that prevents surging. An essentially leakproof screw-on connection complements the assembly and cooperates with the other elements thereof to virtually eliminate spills.

2. Description of the Related Art

Pouring spouts for dispensing the contents of containers are, of course, well known in the art. The U.S. Patents to Sundholm 2,328,363; Dike 3,104,039 and Lampe 3,325,844 being examples of such units. The Dike patent discloses a spout which rotates to close off the pour opening in the screw-on closure. The Lampe patent, on the other hand, discloses a valved closure in which the particular valve used is of the rotating plate type wherein a pair of openings can be moved into registry with one another in the open position and out of registry in the closed one. Valves of this type are satisfactory when used with granular materials but they are difficult to seal and, therefore, tend to leak when used with liquids.

Accordingly, a need exists for a screw-on type valved pouring spout for attachment to the necks of the bottles containing motor oil and the like which need to be turned upside down and placed into small fluid-intake openings before the contents are allowed to flow. Means should also be provided for admitting air to the container while the fluid is flowing so as to eliminate surges and spillage. Preferably, the valve should be one that can be actuated by a finger or the thumb of the hand holding the container while holding the latter upside down with the spout tip already located within the fluid-intake opening.

SUMMARY OF THE INVENTION

Applicant has found that these and other worthwhile objectives can, in fact, be achieved by the novel, yet unobvious, expedient of providing a screw-on type pouring spout containing a ball valve rotatable a mere quarter turn between its open and closed positions by the thumb of the hand holding the container. The interior of the spout is partitioned off to divide same into a fluid-flow passage and an airflow passage superimposed above the latter. The valve, upon actuation, simultaneously opens and closes both of the aforementioned passages.

It is, therefore, the principal object of the present invention to provide a novel and improved pouring spout for attachment to liquid containers.

A second objective is to provide a device of the class described which includes a novel ball valve operative upon actuation to simultaneously close and open fluid-flow and airflow passages stacked one atop the other.

An additional object is to provide a pouring spout of the type aforementioned which is equipped with an actuator for the valve so positioned that the latter can be turned back and forth by the thumb of the hand holding the container.

Another objective of the within-described invention is that of providing a pouring spout for liquids which incorporates an airflow passage stacked atop the fluid-flow passage.

Further objects of the invention are to provide a valved and vented pouring spout for dispensing liquids which is simple, easy to operate, versatile, lightweight, inexpensive, compact, rugged and even decorative in appearance.

Other objects will be in part apparent and in part pointed out specifically hereinafter in connection with the description of the drawings that follows.

BRIEF DESCRIPTION OF THE DRAWINGS

FIG. 1 is a perspective view showing the valved and vented pouring spout of the present invention screwed onto the neck of the type of molded plastic bottle being used as a disposable container for motor oil and the like;

DETAILED DESCRIPTION OF THE PREFERRED EMBODIMENTS

Figure 6:
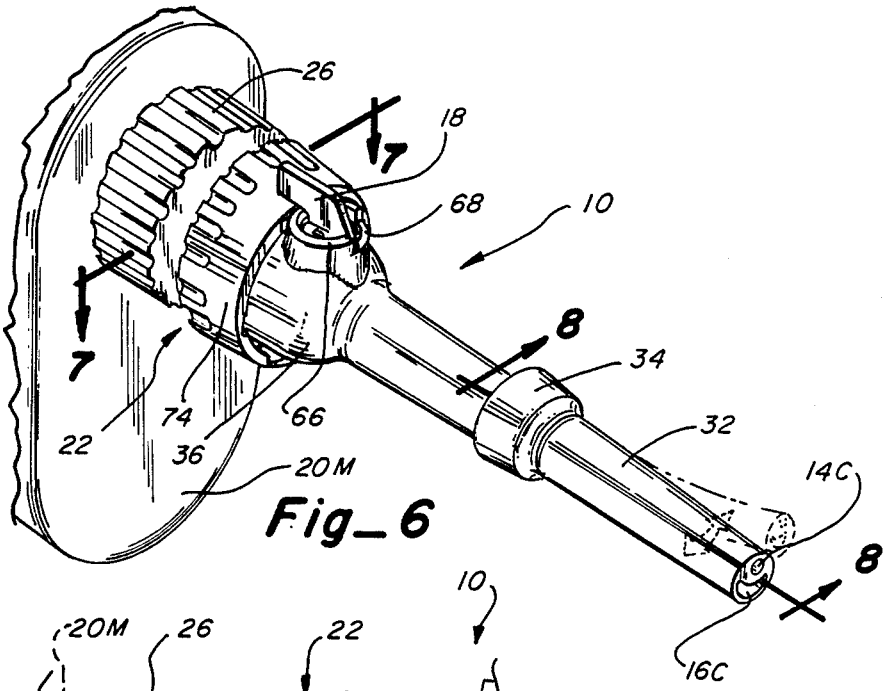
FIG. 6 is a fragmentary perspective view showing the spout equipped with an extension, the scale being the same as in FIG. 1.
Figure 7:
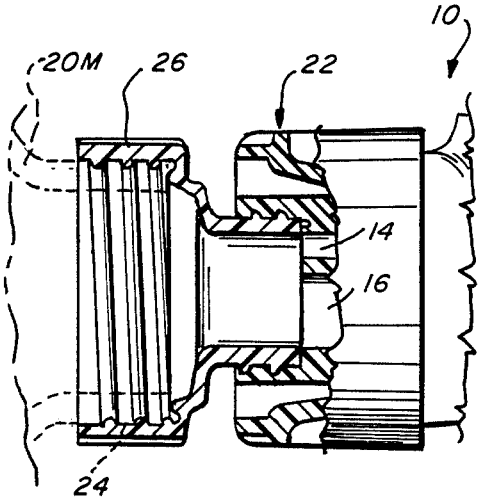
FIG. 7 is a fragmentary section taken along line 7—7 of FIG. 6 to approximately the same scale as FIG. 2.
Figure 9:
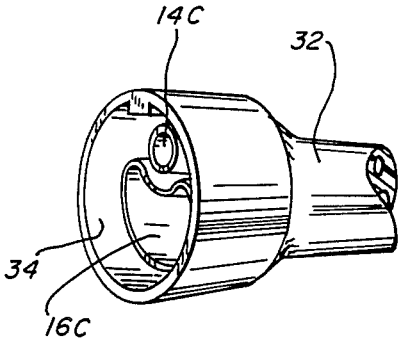
Figure 8:
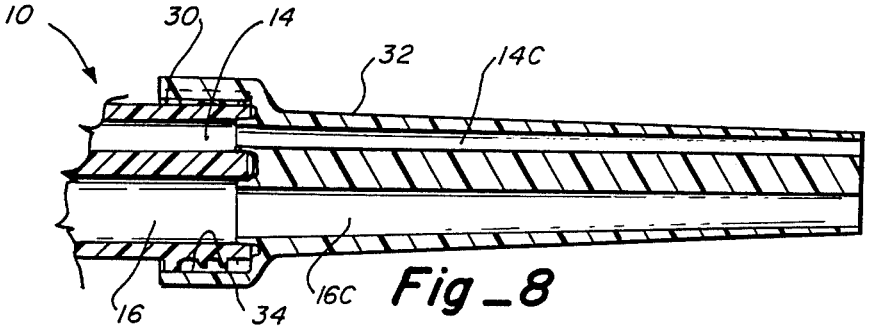
FIG. 8 is a fragmentary longitudinal half section to approximately the same scale as FIG. 2 taken along line 8—8 of FIG. 6; and, FIG. 9 is a fragmentary perspective view of the extension spout, once again to the same scale as FIG. 2.

Referring next to the drawings for a detailed description of the present invention, reference numeral 10 has been chosen to broadly designate the pouring spout in its entirety while numeral 12 has been selected to similarly identify the ball valve used to simultaneously open or close both its airflow passage 14 and its fluid-flow passage 16 using the thumb-actuated fin-like handle 18 while holding the oil bottle 20. The rear end of the spout is shaped to rotatably mount an internally-threaded female connector subassembly which has been broadly designated by reference numeral 22 and which is designed and adapted to screw onto the externally-threaded male counterpart 24 on the neck of the container or, as seen in FIGS. 6 and 7, onto the reducer 26 used to neck-down the necks of oversize containers 20M. The front end 28 of the spout can, if desired, be threaded as shown at 30 to accept either the lid (not shown) off the bottle 20 or, alternatively, a spout extension 32 of the type seen in FIGS. 6, 8 and 9. This spout extension is flexible as represented by phantom lines in FIG. 6. Instead of being internally-threaded, the extension shown has a smooth-surfaced collar 34 adapted for frictional connection to the externally-threaded end 30 of the spout. Extensions of this type can be useful in dispensing the contents of the bottle into hard-to-reach places. As shown, this spout extension is provided with continuations of both the air intake passage 14 and the fluid discharge passage 16, the latter having been identified by reference numerals 14C and 16C, respectively.

Referring specifically to FIGS. 1–3, 5 and 6, it can be seen that just forwardly of the connector subassembly 22, the spout contains an integrally-formed enlargement 36, the interior of which is shaped to define a hemispherically-shaped seat 38 for the ball valve that has been indicated in a general way by reference numeral 40. In the open position of valve 40, it has passages 14B and 16B therein which align with the air intake and fluid discharge passages 14 and 16, respectively, of the spout. The bottom of the ball is slightly truncated to form a flat 42 from which projects a short generally cylindrically-shaped ear 44. The bottom of the seat 38 is similarly flattened as seen at 46 and provided with a semi-cylindrical socket 48 sized and adapted to receive the ear for rotation therein between the open position of the valve shown in the drawings and its closed position rotated a quarter turn counterclockwise as viewed from the top. The top of the ball valve is similarly truncated as indicated at 50 where a valve stem in the form of a pair of upstanding springable generally hook-shaped ears 52 are provided. These ears project up through an opening 54 in the top of the enlargement 36 where they are detachably connected to the actuating handle 18 through openings 56 in the latter. The size of these opening 56 is such as to easily pass the hooked ends of the ears 52 as seen most clearly in FIG. 3. Moreover, the relative positions of the ears and the openings therefor is such that the outer edges of the latter will cam the ears inwardly until the hooked ends pass therethrough, whereupon, these hooked ends will spring back out and releasably lock on top of the cylindrical disk 58 containing these openings and constituting a base for the handle 18.

The underside of the cylindrical base 58 for the handle is annularly-grooved as shown at 60 to receive a gasket 62. Opening 54 in the top of the enlargement 36 is bordered by an annular seat 64 and an upstanding annular flange 66 which cooperate with one another to confine the outside and the underside of the gasket. This annular flange 66 is flat on the top forming a rim 68 as a support for the base of the handle which is somewhat larger. Within that portion of the base resting atop the annular flange and outside the area occupied by the gasket is a stop 70 which rides within a 90° slot 72 in the rim 68 and thus defines as well as limits the open and closed positions of the valve 40.

Connector subassembly 22 serves several important functions in addition to that of detachably connecting the spout to the bottle. For instance, it forms the seat for the rear end of the ball valve and, in addition, seals around the air intake and fluid discharge openings therein. It also releasably latches onto the rear slightly flared funnel-forming end of the spout and holds the valve and its related parts in assembled relation. The details of the connector subassembly referred to above are most clearly revealed in FIGS. 2 and 5 to which reference will now be made.

In essence, the subassembly comprises an external cap-forming portion 74 inside of which is an integrally-formed tubular member 76 which has the internally-threaded portion 24 at its rear end that screws onto the bottle 20 and the ball-engaging spherically-shaped seat 78 at its front end. An air-intake passage 14A and a fluid-discharge passage 16A align with the corresponding passages 14C and 16C of the spout when the subassembly 22 is releasably latched in place onto the rear funnel-forming slightly flared end of the enlarged portion 38 of the spout in a manner which will be described in detail presently. Air intake passages 14C and 14A are connected together by passage 14B when the ball valve is in the open position shown. Likewise, the fluid-discharge passages 16C and 16A are similarly connected together by ball valve passage 16B under these same circumstances. Spherically-shaped seat 78 is bordered at its front end by a circumferential groove 80 into which fits an O-ring 82. This O-ring seats against the rear surface of the ball valve 40 and is held in place by the forwardly-tapering surface 84 on the inside of spout enlargement 36. As thus assembled, O-ring 82 prevents the fluid issuing from the bottle 20 from escaping into the enlarged area 36 of the spout.

A second annular groove 86 borders the front end of the air-intake opening 14A of the tubular member 76 of the connector subassembly 22 and it seats a second O-ring 86 which seals against the opposed spherical surface of the ball valve 40. Thus, the fluid moving through the fluid discharge passages 16 is sealed off from entering the air-intake passages 14 in all positions of the valve as the O-rings 82 and 88 remain at all times in essentially fluid-tight wiping contact therewith.

Figure 1:
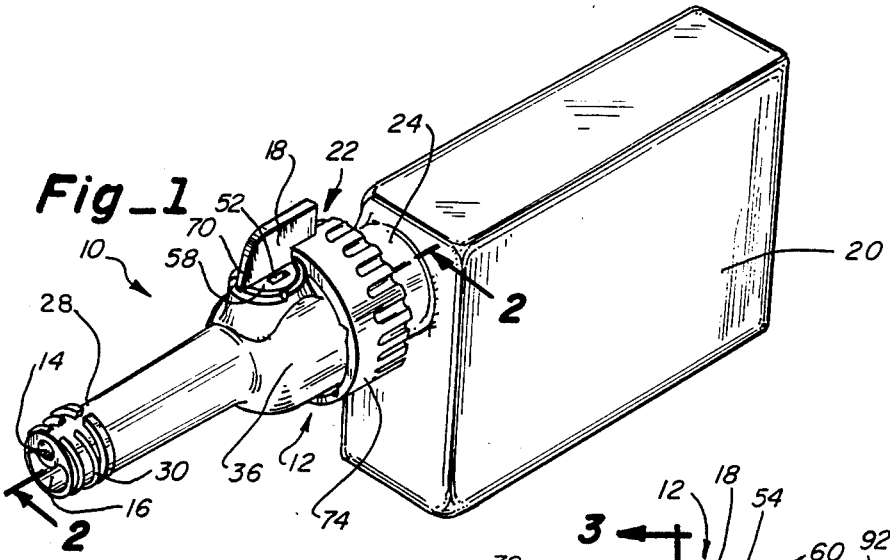
Figure 2:
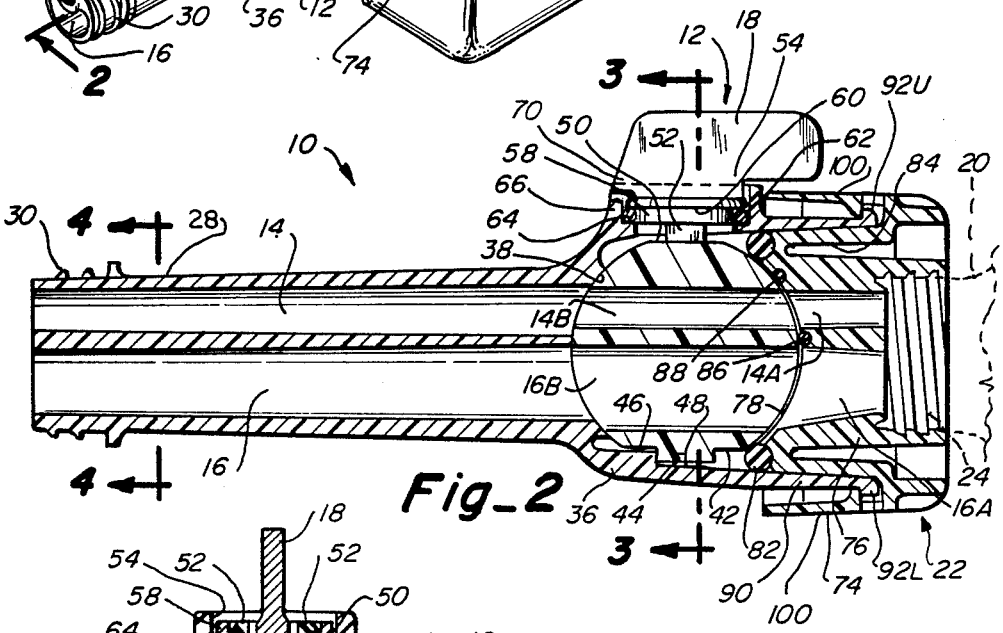
FIG. 2 is a section taken along line 2—2 of FIG. 1 showing the pouring spout alone to a greatly enlarged scale.
Figure 3:
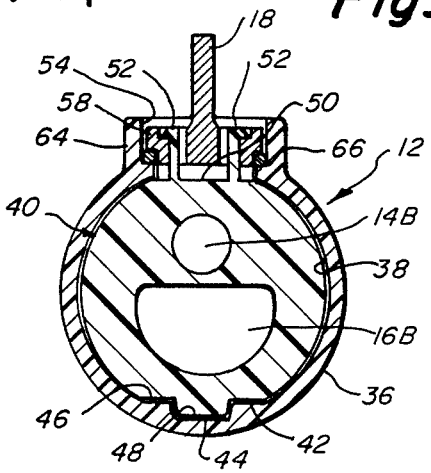
FIG. 3 is a section taken along line 3—3 of FIG. 2 to the same scale.
Figure 4:
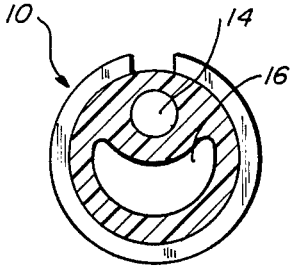
FIG. 4 is a section taken along line 4—4 of FIG. 2, again to the same scale.
Figure 5:
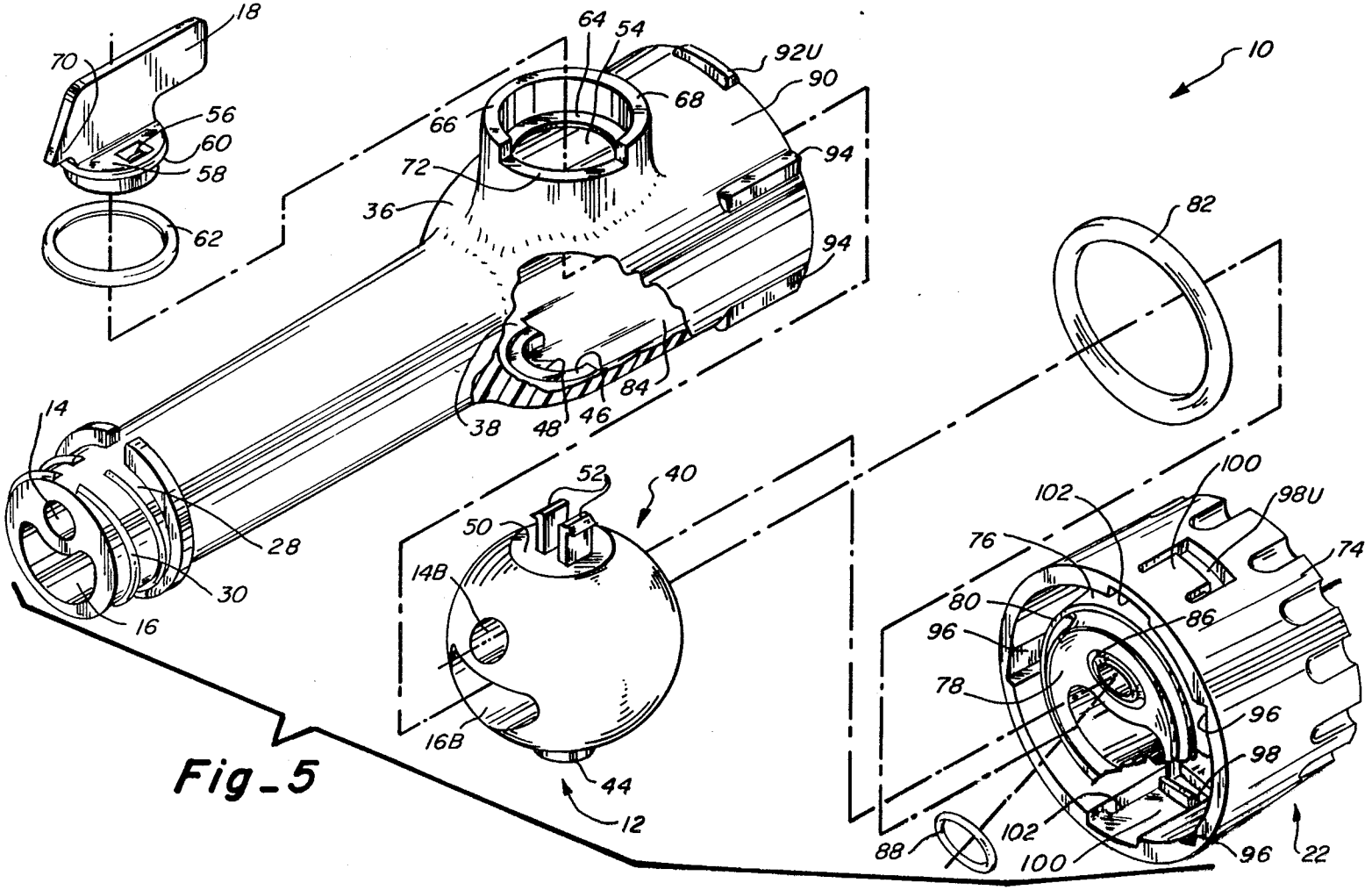
FIG. 5 is an exploded view to a still larger scale.

With continued reference to FIGS. 2 and 5, it can be seen that the rear end of the spout takes the form of a gently-flared skirt 90, the outer surface of which is provided both top and bottom with a diametrically-arranged pair of integrally-formed locking tabs 92U and 92L along with one or more integrally-formed guide tongues 94, the latter being shown only in FIG. 5. The inside surface of the cap-forming portion 74 of the connector subassembly 22 contains grooves 96 (FIG. 5) for the reception of the guide tongues 94 which cooperate therewith to orient the subassembly relative to the air-intake and fluid discharge openings. U-shaped slits 98 cut into the surface of the cap-forming portion 74 in longitudinal alignment with the locking tabs 92U and 92L free bendable fingers 100 which raise up as the tabs pass inside them and along channels 102 therebeneath prior to springing back into place behind them to hold the connector subassembly 22 and related parts in assembled relation.

Detachment of the connector subassembly from the spout, of course, opens up the flared end of the latter which can be used as a small funnel. The valve mechanism will remain in place as the funnel-forming portion is raised into a vertical position due to the connection between the handle 18 and the valve stem even though the projection 44 on the bottom of the ball is no longer retained in the semi-circular socket therefor because of the absence of the O-ring 82 and portion of the spherical seat therebehind that hold the latter in place against seat-forming surface 38.

What is claimed is:

1. A valved and vented pouring spout comprising:

an elongated tubular spout member internally partitioned to divide its interior into an airflow passage and a material flow passage, both extruding longitudinally of the said spout member;

an interior portion of said spout member forming a hemispherically shaped seat a connector section detachably mounted on one end of the spout member, the connector section having thereon a hemispherically shaped seat, said hemispherically shaped seats or said spout member and said connector section forming a spherical pocket therebetween;

an opening between the spherical pocket and the exterior of the spout;

a ball valve body rotatably disposed in the pocket, said body having bores therethrough which, in one rotatable position of the body, are respectively alignable with the passages of the tubular spout member; and actuator means attached to the valve body and projecting through the opening.

* * * * *